US005291167A

United States Patent [19]

Richter

[11] Patent Number: 5,291,167

[45] Date of Patent: Mar. 1, 1994

[54] ARC EXTINGUISHING DEVICE HAVING A FOCUSED FIELD

[75] Inventor: David N. Richter, Mexico, Mo.

[73] Assignee: Square D Company, Palatine, Ill.

[21] Appl. No.: 985,410

[22] Filed: Dec. 4, 1992

[51] Int. Cl.[5] ..... H01H 9/30

[52] U.S. Cl. ..... 335/201; 200/144 R

[58] Field of Search ..... 335/201, 16, 147, 195, 335/202; 200/144 R, 147 R

[56] References Cited

U.S. PATENT DOCUMENTS

| | | | |
|---|---|---|---|
| 2,429,722 | 10/1947 | Jennings | 335/35 |
| 2,811,607 | 10/1957 | Dorfman et al. | 335/35 |
| 2,898,427 | 8/1959 | Nadeau | 200/144 R |
| 4,616,200 | 10/1986 | Fixemer et al. | 335/172 |
| 4,885,441 | 12/1989 | Hisatsune et al. | 200/144 R |

*Primary Examiner*—Lincoln Donovan

*Attorney, Agent, or Firm*—Larry I. Golden; Kareem M. Irfan

[57] ABSTRACT

The present invention provides an arc extinguishing device for disposition along a pre-determined path of movement between two electrical contacts in an electrical distribution device. The device includes a generally U-shaped member having a bight portion defined by a bottom wall with two upstanding side walls. The bight portion has sufficient width to allow the movement of the electrical contacts between the two side walls. A pair of magnetic poles having a magnetic field therebetween is formed with and located near the top edge of each side wall. The device includes means for focusing the magnetic field along the longitudinal center axis through the length of the U-shaped member and in the plane overlapping the path of movement of the electrical contacts so as to increase the magnetic flux density encountered by the electrical contacts.

The present invention also includes a method of assembling an arc extinguishing device which includes the step of interlocking a plurality of magnetic material plates into the shape of a yoke. The yoke having the shape of the device described above.

22 Claims, 2 Drawing Sheets

ARC EXTINGUISHING DEVICE HAVING A FOCUSED FIELD

FIELD OF THE INVENTION

The present invention relates to circuit breakers, circuit interrupters, electrical distribution devices and the like, and more particularly, to an improved arc extinguishing device for use therein.

BACKGROUND OF THE INVENTION

Circuit breakers are commonly used to protect branch circuits in residential and commercial buildings against overload and fault conditions. Basically, a circuit breaker includes a separable pair of electrical contacts, a spring-operated mechanism for effecting separation of the contacts, and a tripping mechanism upon the occurrence of the overload or fault condition. A representative circuit breaker is fully set forth in U.S. Pat. No. 2,889,428, issued to Kingdon et al., commonly assigned to the assignee herein and incorporated herein by reference.

An electric arc is produced each time the circuit breaker contacts are opened or closed. The detrimental effects from the arc on other internal components is most severe during interruption of the electrical contacts. An arc extinguishing mechanism is used to control and extinguish the arc and protect the other components of the circuit breaker.

For example, a common type of arc shield, which is placed in a recess or arc chamber of a circuit breaker is a series of spaced magnetic plates as illustrated in U.S. Pat. No. 2,811,607 issued to Dorfman et al. Another type of arc extinguishing mechanism is set forth in U.S. Pat. No. 2,898,427 issued to Nadeau, which discloses a one-piece u-shaped magnetic metallic member having a plurality of parallel slots with an arc runner portion to lead the arc to a venting passage. U.S. Pat. No. 2,429,722 to Jennings discloses an arc extinguisher using insulating side members mounted between the legs of u-shaped magnetic members and the side walls of the breaker casing. Another example is U.S. Pat. No. 4,616,200 issued to Fixemer et al. which discloses a molded arc barrier projecting into the arc chamber to shield the operating mechanism of the circuit breaker.

Circuit breakers that successfully protect internal components with an arc extinguishing mechanism at high fault levels sometimes fail at intermediate fault levels. The interrupting mechanism which creates the arc is different at high fault compared to intermediate fault levels. At intermediate fault levels, the arc may become immobile causing damage to internal components of the circuit breaker.

The need also arises to distribute more power through enclosures which are the same size or smaller. This requires increasing the electrical rating of the circuit breaker to carry same voltage and current density while decreasing the size of the enclosure housing the components like the arc extinguishing means.

Among the problems caused by increasing the electrical rating of a circuit breaker is the heat emitted by the arc created by interrupting the electrical contacts. Without dissipation of the arc and the heat build-up the other components of the circuit breaker will be damaged.

SUMMARY OF THE INVENTION

Accordingly, the present invention provides an arc extinguishing device for disposition along a pre-determined path of movement between two electrical contacts in an electrical distribution device. The device includes a generally U-shaped member having a bight portion defined by a bottom wall with two upstanding side walls. The bight portion has sufficient width to allow the movement of the electrical contacts between the two side walls. A pair of magnetic poles having a magnetic field therebetween is formed with and located near the top edge of each side wall. The device includes means for focusing the magnetic field along the longitudinal center axis through the length of the U-shaped member and in the plane overlapping the path of movement of the electrical contacts so as to increase the magnetic flux density encountered by the electrical contacts.

The present invention also includes an electrical distribution device which includes a housing and a pair of electrical contacts positioned within the housing. At least one contact is moveable in and out of engagement with the other along a pre-determined path. The electrical distribution device also includes an arc extinguishing device as described above.

The present invention also contemplates a method of assembling an arc extinguishing device. The method includes the step of interlocking a plurality of magnetic material plates into the shape of a yoke. The yoke having the shape of the arc extinguishing device described above.

It is an object of the present invention to provide an arc extinguishing device which overcomes the aforementioned problems affecting interruption of circuit breakers at various fault levels.

Another object of the present invention is to provide an arc extinguishing device which focuses and concentrates a magnetic flux density in the pre-determined path of electrical contacts within a circuit interrupter.

A further object of the invention is to provide an arc extinguishing device which protects the other components of a circuit breaker from exposure to the arc at both high and intermediate fault levels.

Yet another object of the present invention is to provide an arc extinguishing device which improves the mobility of an arc even at intermediate fault levels.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure.

DETAILED DESCRIPTION

Figure 1:
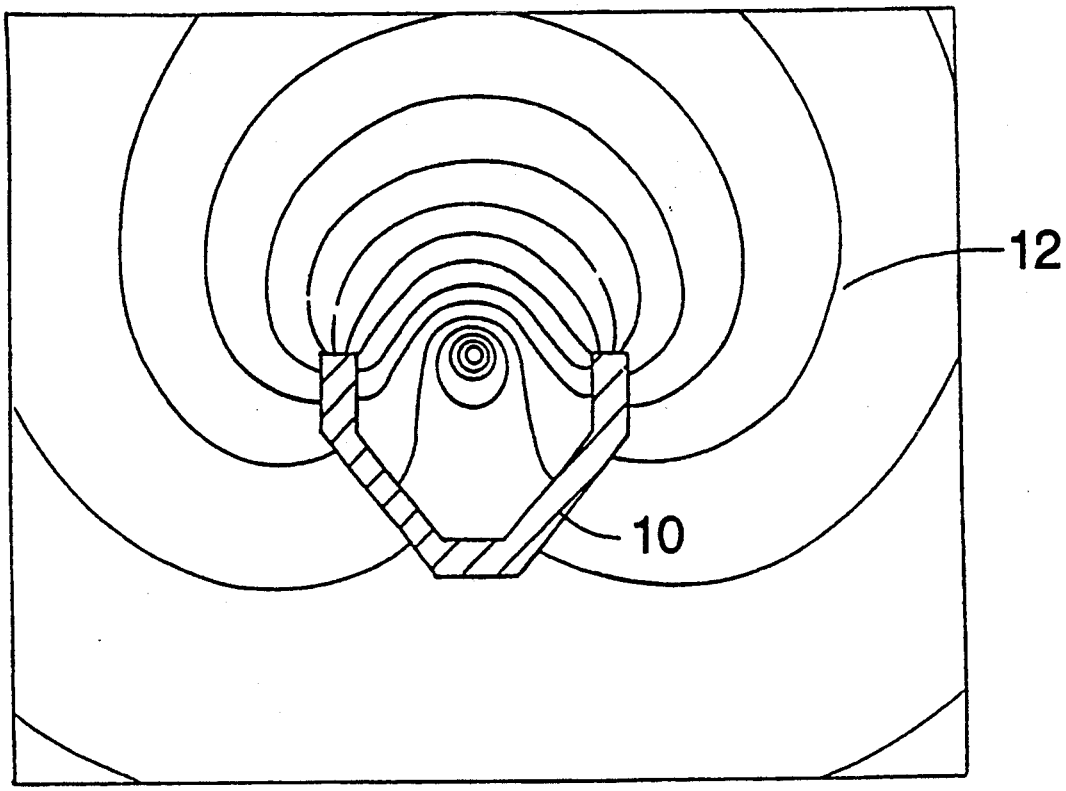
FIG. 1 (PRIOR ART)
FIG. 1 is a cross-sectional view of an arc yoke of the prior art illustrating the lines of magnetic flux emanating therefrom.

Referring to FIG. 1, there is illustrated an isolated view of an arc yoke 10 of the prior art. The lines 12 of magnetic flux illustrate the approximate position and concentration relative to the arc yoke 10.

Figure 2:
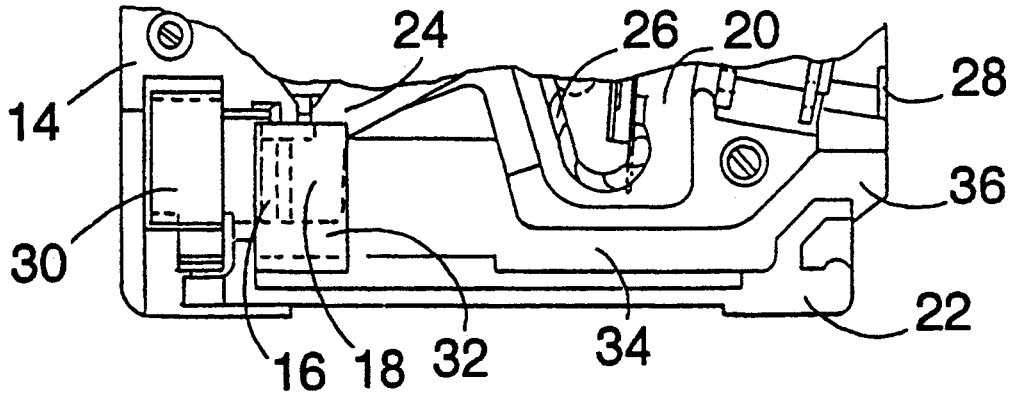
FIG. 2 is a fragmentary side view within the casing of a circuit breaker illustrating the position of the arc extinguishing device of the present invention.

FIG. 2 is a conventional circuit breaker 14 which includes a stationary contact 16 and a movable contact 18 mounted to a trip device 20 within a casing 22. The movable contact 18 is mounted on a contact arm 24 which moves the movable contact through a pre-determined path away from the stationary contact 16. The contact arm 24 is connected to an operating mechanism which is triggered by the trip unit 20 or an operating handle (not shown).

The contact arm 24 is electrically connected to a flexible conductor 26. A terminal assembly 28 connects on the other end of the flexible strap 26. The closed circuit through the circuit breaker 14 extends from a terminal 30 through the stationary contact 16, the movable contact 18, the contact arm 24, the flexible conductor 26, and the terminal assembly 28.

An arc extinguishing device embodiment 32 of the present invention straddles the pre-determined path of movement by the movable contact 18. When an arc is generated by the opening of the contacts 16 and 18, the mobility of the arc is enhanced by the arc device 32 to travel through an arc chamber 34 to a port 36 exiting the casing 22.

Figure 3:
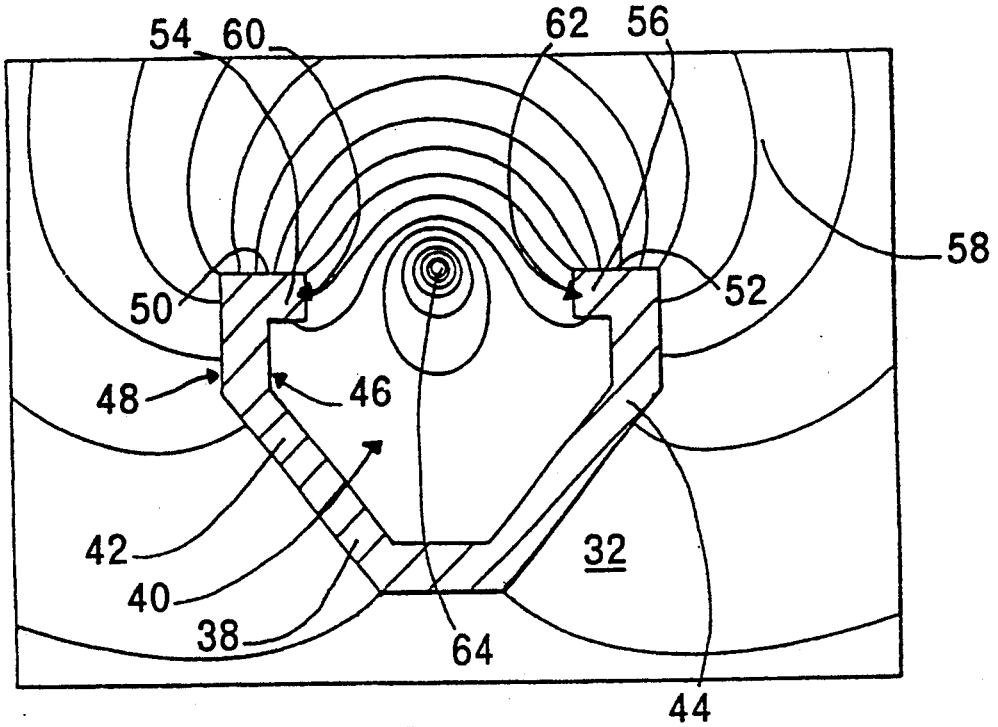
FIG. 3 is a cross-sectional view of an arc extinguishing device embodiment of the present invention illustrating the lines of magnetic flux emanating therefrom.

As best illustrated in FIG. 3, the arc extinguishing device 32 includes a generally u-shaped member 38 having a bight portion 40 defined by a bottom wall 42 with two upstanding side walls 42 and 44. The side walls 42 and 44 have an inside face 46 and an outside face 48 which terminate at the top edges 50 and 52, respectively.

Integrally formed with the side walls 42, and 44 near the top edges 50 and 52 are a pair of magnetic poles 54 and 56. The lines 58 of magnetic flux emanating between the magnetic poles 54, 56 illustrate the approximate position and concentration of the magnetic density therebetween.

Associated with each magnetic pole 54, 56 is a focusing member 60, 62 which is integrally formed with, or otherwise connected to, each side wall near the top edges 50, 52. The focusing members 60, 62 are shaped as a generally rectangular flange which extend perpendicularly inward towards the bight portion 40 from the interior face 46. The focusing members 60, 62 focus the magnetic field from the magnetic poles 54, 56 along the longitudinal center axis at point 64 across the length of the u-shaped member 38 and in the plane overlapping the path of movement of the electrical contacts 16 and 18 as seen in FIG. 2. The longitudinal center axis extends perpendicularly into FIG. 3 at point 64.

Figure 4:
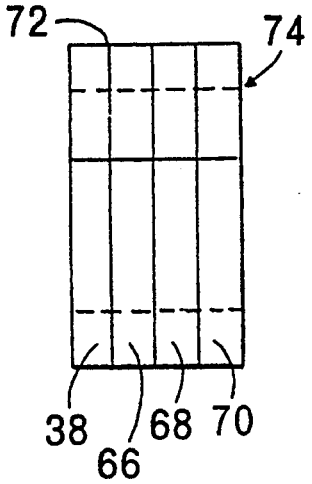
FIG. 4 is a side view of the arc extinguishing embodiment in FIG. 3.

As seen in FIG. 4 the length of the u-shaped member 38 is relatively short compared to its width to form a plate shape. Preferably, a plurality of other similarly shaped members 66, 68, and 70 are connected together with u-shaped member 38. The number of plates like 66 is determined by the physical space available and the power rating of the circuit breaker 14. The slits 72 between the members like 38 and 66, decrease eddy current formation in the members. As the length of the of the u-shaped member increases either by adding additional plates or by making the embodiment of one longer piece, a yoke shape 72 is formed.

Preferably, the members 38, 66, 68, and 70 are connected together by using an interlock, embossing, or semi-pierce method of punching the u-shaped members. The interlock method uses a die to produce a single stack of plates from sheet material. The die makes a cut without completely removing the slug that is formed. Each plate is then locked to the next by forcing the partially displaced slug from the first plate into the cut of the second plate. After a pre-determined number of plates have been interlocked in this manner, the stack is removed from the die as a completed yoke.

Another method of forming the embodiment of FIG. 4 is to stamp out individual plates from a sheet of material. The plurality of plates are then heat-staked or otherwise riveted together. The present invention also contemplates forming a one-piece embodiment using metal injection or powder metallurgy techniques.

Another embodiment of the present invention forms a yoke from one-piece of material to have an appearance similar to embodiment 32 seen in FIG. 4. Slits are formed in the side walls extending from the top edges downwardly towards the bottom wall. The slits extend only partially down the side walls, however, and the bottom wall remains in one piece.

Figure 5:
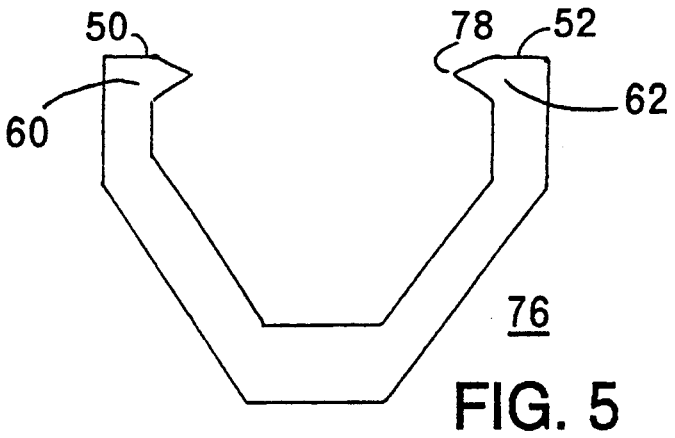
FIG. 5 is a cross-sectional view of another arc extinguishing embodiment of the present invention with angular focusing members.

Other means for focusing the magnetic field from the magnetic poles 54, 56 along the longitudinal center axis through the length of the u-shaped member and in the plane overlapping the path of movement of the electrical contacts 16, 18 is contemplated by the present invention. Referring to FIG. 5, another embodiment 76 of the invention is illustrated. The focusing members 60, 62 have a generally angular form having an apex 78 which extend perpendicularly inward from the top edges 50, 52 of the side walls.

Figure 6:
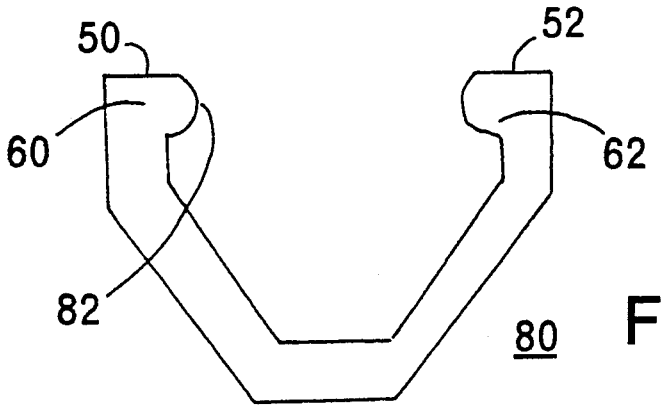
FIG. 6 is a cross-sectional view of a third arc extinguishing embodiment of the present invention with semicircular focusing members.

Another embodiment 80 of the present invention is seen in FIG. 6. The focusing members 60, 62 have a cross-sectional shape of a semi-circle 82 which extends perpendicularly inward from the near the top edges 50, 52 of the side walls.

Preferably the u-shaped member and focussing member are made of nickel plated steel. Other ferromagnetic material is also suitable for use with the present invention.

The following Example is set forth for the purposes of illustration and should not be construed as limiting.

EXAMPLE

Six sample circuit breakers manufactured by the Square D Company were utilized wherein all components were standardized to eliminate variables. The circuit breakers were catalog number Q02100H with a two pole construction and 100 amp rating. These circuit breakers were modified to have a single arc extinguishing device of the present invention positioned on one pole. The other pole of each circuit breaker had two yokes of standard construction. For one-half the circuit breakers the inventive arc device was on the left pole and on the half of the circuit breakers the inventive device was on the right pole.

The inventive arc device had the same width, length and shape as one of the standard arc yokes. The difference was the rectangular shaped focusing members at the top edges of each side wall as described above and illustrated in FIGS. 3 and 4. Three slits were made equidistant from each other in the side walls of the inventive arc device that extended from the top edge of the side wall to the bottom wall but not through the bottom wall. The entire arc device and slits were cut from a block of steel by an electronic discharge machine.

Each circuit breaker was subjected to a testing regime which included multiple "0" shots per pole wherein the test circuit breaker is closed and the circuit is then closed on the fault (breaker). The test circuit was a 240 volt, three phase, grounded "B" phase system with 5 kA of available fault current and a power factor of 45 to 50 percent. Closure on the fault was initiated at 1.5 milliseconds after voltage zero to simulate what are believed to be worst case energy and dielectric recovery values. All tests are on a per pole. All voltages measured are phase to phase. The 5 kA level is an intermediate level compared to a high fault level of 10 kA or 22 kA. The performance of each breaker is presented in Table 1 below which provides the number of multiple loop shots and when they occurred. An asterisk indicates the pole where the inventive arc device resided.

TABLE 1

| Sample | Pole | Trip Level (amps-rms) | Shot Type | I Peak (amps) | $I^2t$ Power (joules) |
|---|---|---|---|---|---|
| 1 | L* | 1480 | 1st | 6,775 | 178,896 |
| | R | 1050 | 1st | 6,750 | 174,648 |
| | L* | | 2nd | 7,325/4,965 | 308,768 |
| | R | | 2nd | 6,565 | 166,064 |
| 2 | L* | 1390 | 1st | 6,805 | 181,488 |
| | R | 930 | 1st | 6,745 | 173,488 |
| | L* | | 2nd | 6,700/5,035 | 272,032 |
| | R | | 2nd | 6,710/4,985 | 271,216 |
| 3 | L* | 1230 | 1st | 6,590 | 164,080 |
| | R | 980 | 1st | 6,480 | 155,648 |
| | L* | | 2nd | 6,515/5,055/ 5,170/5,070/ 4,910 | 563,520 |
| | R | | 2nd | 6,635/5,030 | 267,472 |
| 4 | L | 1270 | 1st | 6,730/4,905 | 266,384 |
| | R* | 870 | 1st | 6,725 | 172,136 |
| | L | | 2nd | 6,535/5,025 | 260,752 |
| | R* | | 2nd | 6,740/4,990 | 269,616 |
| 5 | L | 1430 | 1st | 6,565 | 160,744 |
| | R* | 1290 | 1st | 6,775/4,895 | 270,640 |
| | L | | 2nd | 6,550/5,020 | 260,480 |
| | R* | | 2nd | 6,280 | 146,184 |
| 6 | L | 1320 | 1st | 6,640/4,970 | 264,128 |
| | R* | 1200 | 1st | 6,640 | 166,256 |
| | L | | 2nd | 6,535/5,055/ 5,145 | 368,256 |
| | R* | | 2nd | 6,750/4,970 | 273,120 |

As an additional control for these tests, four additional circuit breakers as described above were modified by placing in each pole of each circuit breaker a single instead of a double yoke of conventional design. The testing regime described above was used and the test results are complied in Table 2 below.

TABLE 2

| Sample | Pole | Trip Level (amps-rms) | Shot Type | I Peak (amps) | $I^2t$ Power (joules) |
|---|---|---|---|---|---|
| 1 | L | 1650 | 1st | 6,830 | 184,512 |
| | R | 1280 | 1st | 6,705 | 176,224 |
| | L | | 2nd | No trace | |
| | R | | 2nd | 7,360 | 216,552 |
| 2 | L | 1100 | 1st | 6,650/4,835 5,085 | 363,184 |
| | R | 990 | 1st | 6,700 | 172,064 |
| | L | | 2nd | 6,655/4,905 5,025/4,865 | 462,920 |
| | R | | 2nd | 6,595 | 167,776 |

TABLE 2-continued

| Sample | Pole | Trip Level (amps-rms) | Shot Type | I Peak (amps) | $I^2t$ Power (joules) |
|---|---|---|---|---|---|
| 3 | L | 1350 | 1st | 6,740/4,955 | 272,368 |
| | R | 1110 | 1st | 6,760/4,900 | 273,296 |
| | L | | 2nd | 6,570/5,030 | 266,336 |
| | R | | 2nd | 6,255 | 146,096 |
| 4 | L | 1260 | 1st | 6,790/4,920 | 273,008 |
| | R | 880 | 1st | 6,605 | 165,056 |
| | L | | 2nd | 6,640/4,975 5,035/4,940 4,800 | 554,800 |
| | R | | 2nd | 6,435/4,915 5,075/5,010 4,850/4,160 | 612,920 |

The number of loops performed successfully by the above circuit breakers using an inventive arc device is compared to the usage of a double conventional yoke and a single conventional yoke in Table 3 complied below.

TABLE 3

| Loops | Invention | Single Conventional | Double Conventional |
|---|---|---|---|
| | | First "O" Shot | |
| 1 | 5 | 4 | 4 |
| 2 | 1 | 2 | 3 |
| >2 | 0 | 0 | 1 |
| | | Second "O" Shot | |
| 1 | 1 | 1 | 3 |
| 2 | 4 | 4 | 1 |
| >2 | 1 | 1 | 3 |

These tests demonstrate that a circuit breaker with one inventive arc device performs as well as two conventional yokes now used commercially. Yet, the inventive arc device is about the same size as one conventional yoke. The control set of circuit breakers using only on conventional yoke performed far worse than either of the other test samples.

One of the advantages of the inventive arc device is that it uses less steel compared to the conventional practice of using two yokes. Reducing the steel content for the number of yokes reduces the likelihood of damage to or interference with other internal components in the circuit breakers due to a high fault interruption. There is simply less material available to burn off the yoke and end up elsewhere in the circuit breaker.

The present invention focuses the magnetic field of an arc yoke or plate in the path of the electrical contacts to control and cool the arc created by their interruption. Since the arc is a plasma of charge carriers, it interacts with the magnetic field to produce a force according to the equation $F_{mag}=QU\times B$. The force affects the mobility of the arc. For a comparable arc current, the present invention concentrates the magnetic field on the arc to increase the force acting on the arc and, thus, the mobility of the arc. As the mobility of the arc increases the likelihood of damage to other components in the circuit breaker decreases.

At intermediate fault levels the present invention improves the mobility of the arc compared to conventional arc yokes. Since the arc current is generally lower at intermediate fault levels compared to high fault levels, the mobility of the arc within comparable yokes is also lower. The present invention, however, improves the arc mobility even at lower fault levels compared to conventional arc yokes.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. An arc extinguishing device for disposition along a pre-determined path of movement between two electrical contacts in an electrical distribution device, the device comprising:

a generally U-shaped member having a bight portion defined by a bottom wall with two upstanding side walls, the bight portion having sufficient width to allow the movement of the electrical contacts between the two side walls;

a pair of magnetic poles having a magnetic field therebetween, one of the poles being formed with and located near the top edge of each wall; and means for focusing the magnetic field along the longitudinal center axis through the length of the U-shaped member and in the plane overlapping the path of movement of the electrical contacts so as to increase the magnetic flux density encountered by the arc created by interrupting the electrical contacts, the focusing means having a focusing member integrally formed with each side wall near the top edge and extending perpendicularly inward therefrom.

2. The device of claim 1 wherein the cross-sectional shape of each focusing member being generally rectangular.

3. The device of claim 1 wherein the cross-sectional shape of each focusing member being angular forming an apex.

4. The device of claim 1 wherein the cross-sectional shape of each focusing member being generally semicircular.

5. The device of claim 1 wherein the u-shaped member has a relatively short length compared to its width forming a plate.

6. The device of claim 5 wherein the device further includes a plurality of u-shaped members formed as plates positioned and connected together in a series.

7. The device of claim 1 wherein the u-shaped member has a relatively long length compared to its width forming a yoke.

8. The device of claim 7 wherein the yoke includes a plurality of slits formed in the side walls, each slit extending from the top edge perpendicularly downward therefrom.

9. The device of claim 1 wherein the device is made of steel.

10. The device of claim 9 wherein the steel is nickel coated.

11. An electrical distribution device comprising:

a housing;

a pair of electrical contacts positioned within the housing, at least one contact being moveable in and out of engagement with the other along a predetermined path;

an arc extinguishing device disposed along the predetermined path of movement, the device having a generally U-shaped member having a bight portion defined by a bottom wall with two upstanding side walls, the bight portion having sufficient width to allow the movement of the electrical contacts between the two side walls;

a pair of magnetic poles having a magnetic field therebetween, one of the poles being formed with and located near the top edge of each side wall; and means for focusing the magnetic field along the longitudinal center axis through the length of the U-shaped member and in the plane overlapping the path of movement of the electrical contacts so as to increase the magnetic flux density encountered by the arc created by interrupting the electrical contacts the focusing means having a focusing member integrally formed with each side wall near the top edge and extending perpendicularly inward therefrom.

12. The device of claim 11 wherein the cross-sectional shape of each focusing member being generally rectangular.

13. The device of claim 11 wherein the cross-sectional shape of each focusing member being angular forming an apex.

14. The device of claim 1 wherein the cross-sectional shape of each focusing member being generally semicircular.

15. The device of claim 11 wherein the u-shaped member has a relatively short length compared to its width forming a plate.

16. The device of claim 15 wherein the device further includes a plurality of u-shaped members formed as plates positioned and connected in a series.

17. The device of claim 11 wherein the u-shaped member has a relatively long length compared to its width forming a yoke.

18. The device of claim 17 wherein the yoke includes a plurality of slits formed in the side walls, each slit extending from the top edge perpendicularly downward therefrom.

19. The device of claim 11 wherein the device is made of stainless steel.

20. The device of claim 19 wherein the steel is nickel coated.

21. The device of claim 11 wherein the electrical distribution device is a circuit breaker.

22. A method of assembling an arc extinguishing device, the method including the step of:

interlocking a plurality of magnetic material plates into the shape of a yoke, the yoke including:

a generally U-shaped member having a bight portion defined by a bottom wall with two upstanding side walls, the bight portion having sufficient width to allow the movement of the electrical contacts between the two side walls;

a pair of magnetic poles having a magnetic field therebetween, one of the poles formed with and located near the top edge of each side wall; and means for focusing the magnetic field along the longitudinal center axis through the length of the U-shaped member and in the plane overlapping the path of movement of the electrical contacts so as to increase the magnetic flux density encountered by the arc created by interrupting the electrical contacts, the focusing means having a focusing member integrally formed with each side wall near the top edge and extending perpendicularly inward therefrom.

* * * * *

UNITED STATES PATENT AND TRADEMARK OFFICE

CERTIFICATE OF CORRECTION

PATENT NO : 5,291,167

DATED : March 1, 1994

INVENTOR(S): David N. Richter

It is certified that error appears in the above-identified patent and that said Letters Patent is hereby corrected as shown below:

In column 6, TABLE 3,

Please delete "Single Conventional" in the heading of column 3 of TABLE 3 and replace with --Double Conventional--.

Please delete "Double Conventional" in the heading of column 4 of TABLE 3 and replace with --Single Conventional--.

Signed and Sealed this

Fourteenth Day of July, 1998

Bruce Lehman

*Attest:*

BRUCE LEHMAN

*Attesting Officer*

*Commissioner of Patents and Trademarks*